US007125374B2

(12) United States Patent
Abramson et al.

(10) Patent No.: US 7,125,374 B2
(45) Date of Patent: Oct. 24, 2006

(54) FOLDING MACHINE WITH STACKING ARM

(75) Inventors: Richard Abramson, Glen Ellyn, IL (US); John Kosla, Chicago, IL (US)

(73) Assignee: The Hedman Company, Elk Grove Village, IL (US)

( * ) Notice: Subject to any disclaimer, the term of this patent is extended or adjusted under 35 U.S.C. 154(b) by 0 days.

(21) Appl. No.: 10/806,926

(22) Filed: Mar. 23, 2004

(65) Prior Publication Data

US 2005/0215409 A1 Sep. 29, 2005

(51) Int. Cl.
*B31F 7/00* (2006.01)
*B65H 31/20* (2006.01)
*B65H 31/04* (2006.01)

(52) U.S. Cl. ..... 493/420; 493/419; 493/421; 271/207; 271/213; 271/220; 271/223

(58) Field of Classification Search ..... 493/405, 493/416, 419, 420, 421; 271/3.01, 207, 213, 271/220, 223
See application file for complete search history.

(56) References Cited

U.S. PATENT DOCUMENTS 3,178,171 A * 4/1965 Springer et al. ..... 493/421
3,568,401 A * 3/1971 Bonsch ..... 53/569
4,701,233 A 10/1987 Beck et al.
4,844,131 A 7/1989 Anderson et al.
4,875,965 A 10/1989 Marzullo
5,164,906 A 11/1992 Mahmoodi et al.
5,242,369 A * 9/1993 Eschweiler ..... 492/421
5,520,603 A * 5/1996 Bluthardt et al. ..... 493/421
5,554,094 A 9/1996 Viens
5,669,277 A 9/1997 Perrone
6,024,682 A 2/2000 Mandel et al.
6,086,698 A * 7/2000 Spitler ..... 156/227
6,206,817 B1 3/2001 Sette et al.
6,251,055 B1 6/2001 Evers et al.
6,277,059 B1 * 8/2001 Groenenberg ..... 493/417
2002/0069954 A1 6/2002 Sette et al.
2003/0036468 A1 2/2003 Blank et al.
2003/0080486 A1 5/2003 Ifkovits et al.
2003/0083183 A1 5/2003 Auerbach et al.

* cited by examiner

*Primary Examiner*—Stephen F. Gerrity
*Assistant Examiner*—Christopher Harmon
(74) *Attorney, Agent, or Firm*—Seyfarth Shaw LLP

(57) ABSTRACT

A paper folding machine is provided including a housing having upper and lower fold plates constructed for quick and easy removal of the upper plates from the machine so that repairs may be made. The machine includes an automatically adjustable stacking arm movable to positions corresponding to the settings of the machine for fold type and size.

14 Claims, 14 Drawing Sheets

FOLDING MACHINE WITH STACKING ARM

The present invention pertains to a paper folding machine, and in particular a paper folding machine having a stacking arm.

BACKGROUND OF THE INVENTION

Paper folding machines are known that provide for C-folds, Z-folds and half-folds. For example, U.S. Pat. No. 5,554,094, which is incorporated herein by reference, discloses the processing of paper sheets to provide different types of folds. In the Z-fold format, a paper sheet is folded twice to form three sections with the ends of the sheet along opposite sides of the center section. In a C-fold format, the sheet is folded twice with its ends inward and overlapping each other to form three sections. In a half-fold format with a paper sheet is folded once to form two sections. The sheets can also be folded with or without inserts inserted therein.

Referring to FIGS. 1A and 1B a prior-art folding apparatus 12 is shown set up to form a paper sheet with a Z-fold. The folding apparatus 12 has a supply device 42, a folding device 44 and an output device 46. The supply device 42 accepts a paper sheet 28 from a conveyor system with the document 18 in flat condition with an insert 26 thereon. The trailing edges of the document 18 and insert 26 are aligned to form a trailing edge 48 of the paper sheet 28 spaced from a leading edge 50 thereof. The supply device 42 includes a supply guide 52 with a supply conveyor 54 thereabove. The supply conveyor 54 has two pusher devices 56 thereon moving in the clockwise direction in FIG. 1A. One of the pusher devices 56 engages the trailing edge 48 of the paper sheet 28 to move the paper sheet 28 into a nip 58 formed by cooperating upper and lower rollers 60, 62 of the folding device 44 with the trailing edge of the document 18 and insert aligned as indicated by position 5*a* in FIG. 1B. The upper roller 60 continually rotates clockwise while the lower roller 62 continually rotates counterclockwise, as viewed in FIG. 1A, to accept the paper sheet 28 from the supply device 42.

Along the path of the paper sheet 28 through the folding apparatus 12, the folding device 44 has first, second and third stations 64, 66, 68, respectively. Various operations can be performed at these stations, depending upon how the folding device 44 is arranged, to fold the paper sheet 28 in one of the Z-fold, C-fold or half-fold formats.

In FIG. 1A, the folding device 44 has been set up to perform a Z-fold on the paper sheet 28. To perform a Z-fold on the paper sheet 28, the first station 64 is set up with a diverting device 70 and a buckle plate 72. The diverting device 70 is for diverting the leading edge 50 of the paper sheet 28 as the paper sheet 28 moves in a first path (see position 5*a*) and changing a direction of movement of the leading edge 50 to a second path (see position 5*b*) into the buckle plate 72. The diverting device 70 is moveable between an operative position (shown in solid line in FIG. 1A) in the first path of the paper sheet 28 as the leading edge 50 thereof exits from the conveyor system and an inoperative position (shown in phantom line in FIG. 1A) spaced from the first path of the paper sheet 28.

The buckle plate 72 has an adjustable stop 74 positionable by the user depending upon the size of the paper sheet 28. After the paper sheet 28 enters the buckle plate 72, the diverting device 70 moves to its inoperative position shown in phantom line in FIG. 1A. This movement is accomplished pneumatically and is controlled by a computer processing unit which is signaled by an appropriately located sensor (not shown) to detect the passage of the leading edge 50 of the paper sheet 28. With the diverting device 70 in its inoperative position, the leading edge 50 will engage the adjustable stop 74 to stop further movement of the paper sheet 28 in the second path. However, the cooperating rollers 60, 62 continue to drive the paper sheet 28 causing an intermediate portion of the paper sheet 28 between the leading and trailing edges 50, 48 thereof to engage a nip 76 formed by cooperating upper and lower rollers 78,80. The upper roller 78 continually rotates clockwise while the lower roller 80 continually rotates counterclockwise, as viewed in FIG. 1A, to accept the paper sheet 28 and create a first folded edge 82 therein as shown at position 5*c* as the paper sheet 28 is drawn through the nip 76 in a third path.

At the second station 66, a buckle plate 84 has been set up to accept the paper sheet 28 coming from the cooperating rollers 78,80 in the third path. The buckle plate 84 has an adjustable stop 86 in the third path for stopping movement of the folded edge 82 of the paper sheet 28 along the third path as shown in position 5*d*. After the folded edge 82 of the paper sheet 28 is stopped, the cooperating rollers 78,80 drive the intermediate portion of the paper sheet 28 between a nip 88 formed between the lower roller 80 and a roller 90 (position 5*e*). The roller 90 is continually driven in a clockwise direction, as viewed in FIG. 1A. The rollers 80, 90 draw the paper sheet 28 through the nip 88 in a fourth path to create a folded edge 92 at the intermediate portion of the paper sheet 28 between the folded edge 82 and the trailing edge 48 thereof (position 5*e*).

As the paper sheet 28 enters the third station 68, a first bypass device 91 located in the fourth path after the nip 88 deflects the paper sheet 28 into a nip 94 formed between the roller 90 and a roller 96. The roller 96 is continually driven in a counterclockwise direction, as viewed in FIG. 1A. The rollers 90,96 draw the paper sheet 28 through the nip 94 sending the paper sheet 28 into the output device 46. The output device 46 includes an output guide 98 and an output conveyor 100 designed to deliver the paper sheet 28 to the enveloper as shown by position 5*f*. Thus, a Z-folded paper sheet is formed.

In FIGS. 2A and 2B the folding apparatus 12 is arranged to provide C-folding. It should be noted that a second bypass device 102 has been mounted at the second station 66 while a buckle plate 104 has been mounted in the third station 68. The buckle plate 104 has an adjustable stop 106 positionable by the user depending upon the size of the paper sheet 28. After the paper sheet 28 enters the folding apparatus 12, the diverting device 70 diverts the leading edge 50 of the paper sheet 28 as the paper sheet 28 moves in a first path (see position 6*a*) and changes a direction of movement of the leading edge 50 to a second path (see position 6*b*) into the buckle plate 72. The diverting device 70 moves from its operative position (shown in solid line in FIG. 2A) in the first path of the paper sheet 28 as the leading edge 50 thereof exits from the conveyor system, to its inoperative position (shown in phantom line in FIG. 2A) spaced from the first path of the paper sheet 28. With the diverting device 70 in its inoperative position, the leading edge 50 will engage the adjustable stop 74 to stop further movement of the leading edge 50 of the paper sheet 28 in the second path. The cooperating rollers 60, 62 continue to drive the paper sheet 28 causing an intermediate portion of the paper sheet 28 between the leading and trailing edges 50, 48 thereof to engage the nip 76 formed by cooperating upper and lower rollers 78, 80 to create a first folded edge 82 therein as the paper sheet 28 is drawn through the nip 76 in a third path.

At the second station 66, the second bypass device 102 has been set up to accept the paper sheet 28 coming from the cooperating rollers 78, 80 in the third path. The second bypass device 102 located in the third path after the nip 76 deflects the paper sheet 28 into the nip 88 formed between the rollers 80, 90 (position 6*c*).

At the third station 68, the paper sheet 28 enters the buckle plate 104 traveling in a fourth path (position 6*d*). When the folded edge 82 of the paper sheet 28 engages the adjustable stop 106, further movement thereof in the fourth path is stopped. However, the cooperating rollers 90,96 drive the intermediate portion of the paper sheet 28 between the nip 94, the rollers 90,96 drawing the paper sheet 28 through the nip 94 in a fifth path to create a folded edge 108 at the intermediate portion of the paper sheet 28 between the folded edge 82 and the trailing edge 48 thereof. The paper sheet 28 is delivered into the output device 46. Thus, a C-folded paper sheet is formed.

In FIGS. 3A and 3B the folding apparatus 12 is arranged to provide half-folding with a thru feed. It should be noted that the second bypass device 102 has been mounted at the second station 66 while the first bypass device 91 has been mounted in the third station 68. After the paper sheet 28 enters the folding apparatus 12, the diverting device 70 diverts the leading edge 50 of the paper sheet 28 as the paper sheet 28 moves in a first path (see position 7*a*) and changes a direction of movement of the leading edge 50 to a second path (see position 7*b*) into the buckle plate 72. The diverting device 70 moves from its operative position (shown in solid line in FIG. 3A) in the first path of the paper sheet 28 as the leading edge 50 thereof exits from the conveying station to its inoperative position (shown in phantom line in FIG. 3A) spaced from the first path of the paper sheet 28. With the diverting device 70 in its inoperative position, the leading edge 50 will engage the adjustable stop 74 to stop further movement of the leading edge 50 of the paper sheet 28 in the second path. The cooperating rollers 60, 62 continue to drive the paper sheet 28 causing the intermediate portion of the paper sheet 28 between the leading and trailing edges 50, 48 thereof to engage the nip 76 formed by cooperating upper and lower rollers 78,80 to create a folded edge 110 therein as the paper sheet 28 is drawn through the nip 76 in a third path.

At the second station 66, the output conveyor 100 has been set up to accept the paper sheet 28 coming from the cooperating rollers 78, 80 in the third path. The second bypass device 102 located in the third path after the nip 76 deflects the paper sheet 28 into a fourth path between the nip 88 formed by the rollers 80,90 (position 7*c*).

As the paper sheet 28 enters the third station 68, the first bypass device 91 located in the fourth path after the nip 88 deflects the paper sheet 28 into the nip 94 formed between the roller 90 and a roller 96 (position 7*e*). The rollers 90,96 draw the paper sheet 28 through the nip 94 sending the paper sheet 28 into the output device 46. Thus, a half-folded paper sheet is formed.

In FIGS. 4A and 4B the folding apparatus 12 is arranged to provide half-folding with a downward feed direction. This format of folding cannot be accomplished with an insert forming part of the paper sheet 28, i.e., the paper sheet 28 is insertless. It should be noted that the buckle plate 84 has been mounted at the second station 66 while the bypass device 91 has been mounted in the third station 68. Also, the diverting device 70 and buckle plate 72 have been removed. Alternatively, the diverting device 70 can merely be placed in its inoperative position. After the paper sheet 28 enters the folding apparatus 12, the cooperating rollers 60,62 move the paper sheet 28 in a first path (see position 8A) to engage the nip 76 formed by cooperating upper and lower rollers 78,80.

As the paper sheet 28 is drawn through the nip 76, the buckle plate 84 at the second station 66 accepts the paper sheet 28 coming from the cooperating rollers 78, 80. The adjustable stop 86 stops the movement of the leading edge 50 of the paper sheet 28 as shown in position 8*c*. After the paper sheet 28 is stopped, the cooperating rollers 78, 80 drive the intermediate portion of the paper sheet 28 between the nip 88 formed between the rollers 80, 90. The rollers 80, 90 draw the paper sheet 28 through the nip 88 to create a folded edge 112 at the intermediate portion of the paper sheet 28.

As the paper sheet 28 enters the third station 68, the first bypass device 91 located after the nip 88 deflects the paper sheet 28 into the nip 94 formed between the rollers 90,96 (position 8*d*). The rollers 90,96 drawing the paper sheet 28 through the nip 94 sending the paper sheet 28 into the output device 46. Thus, a half-folded paper sheet is formed.

In FIGS. 5A and 5B the folding apparatus 12 is arranged to provide half-folding with an upward feed direction. This format of folding cannot be accomplished with an insert forming part of the paper sheet 28, i.e., the paper sheet 28 is insertless. It should be noted that the second bypass device 102 has been mounted at the second station 66 while the buckle plate 104 has been mounted in the third station 68. Also, the diverting device 70 and buckle plate 72 have been removed. Alternatively, the diverting device 70 can merely be placed in its inoperative position. After the paper sheet 28 enters the folding apparatus 12, the cooperating rollers 60,62 move the paper sheet 28 in a first path (see position 9*a*) to engage the nip 76 formed by cooperating upper and lower rollers 78,80.

As the paper sheet 28 is drawn through the nip 76, the bypass device 102 at the second station 66 located after the nip 76 deflects the paper sheet 28 into the nip 88 formed between the rollers 80,90 (position 9*b*). At the third station 68, the paper sheet 28 enters the buckle plate 104 (position 9*c*). When the paper sheet 28 engages the adjustable stop 106, further movement of the leading edge 50 is stopped. However, the cooperating rollers 90,96 drive the intermediate portion of the paper sheet 28 between the nip 94. The rollers 90,96 drawing the paper sheet 28 through the nip 94 to create a folded edge 114 at the intermediate portion of the paper sheet 28. The paper sheet 28 is delivered into the output device 46. Thus, a half-folded paper sheet is formed.

Such known folding machines as discussed above require complicated and expensive electronic controls and sensors in order to provide for the proper processing of the paper sheets. As well, such known folding machines have output trays or stacking plates where folded paper sheets are discharged from the folding machine. When hundreds of sheets are discharged each minute, such folded sheets can become disorganized, unorderly and fall on the floor. Thus, a means of maintaining the folded sheets being discharged in an orderly and shingled stack is desired. As well, when the folded discharged sheets have different sizes it is even more difficult to keep them orderly.

Therefore, there is desired a paper folding machine that provides for all of the above described folding functions and a means of maintaining the folded discharged sheets of different sizes, but, provides for an inexpensive, uncomplicated processing mechanism that is inexpensive and simple to manufacture, assemble and operate, while allowing for easy access to the internal parts of the folding machine when cleaning or repairs are necessary. There is also desired automatic mechanical means for processing different sizes and types of paper sheets.

SUMMARY OF THE INVENTION

The present invention provides for a folding machine comprising a housing having a fold plate having an adjustment bar for providing a type of fold for the fold plate, an input table attached to the housing for feeding paper sheets into the housing for processing the paper sheets according to the position of the adjustment bar, a stacking table attached to the housing for receiving the processed paper sheets exiting the housing and a stacking arm attached to the housing adjacent the stacking table, the stacking arm having a roller for assisting in stacking of the processed paper sheets exiting the housing and a mechanical link connecting the stacking arm and adjustment bar providing for adjustment of the stacking arm relative to the type of fold provided by the fold plate. In an embodiment, the mechanical link may include a pivot arm and a support arm connected at a pivot point and the roller attached at an end of the support arm. In an embodiment, the folding machine may further comprise an adjustment arm attached to the pivot arm for adjusting the stacking arm relative to a type of fold selected for the folding machine.

In an embodiment, the adjustment arm may provide for adjustment of the stacking arm corresponding to an orientation of the adjustment bar of the fold plate that controls the type of fold provided by the paper folding machine. In an embodiment, the adjustment arm may be attached to the adjustment bar so that upon adjustment of the adjustment arm the stacking arm is simultaneously moved in order to adjust the stacking arm corresponding to the type-of-fold. In an embodiment, the folding machine may further comprise an adjustment bar that slides vertically along the fold plate and the adjustment arm is pivotally attached to the adjustment bar so that the adjustment arm causes the roller of the stacking arm to move along the stacking table corresponding to the movement of the adjustment bar. In an embodiment, the fold plate may include a slot and multiple fold type indicia including large size sheet indicia at a first end of the slot and small size sheet indicia at a second end of the slot and the adjustment bar is slidingly mounted within the slot and movable between the large and small size sheet indicia.

In an embodiment, the stacking table may include a receiving end where folded paper sheets exit the housing and initially are introduced to the table and an accumulating end where the end paper sheets move after additional folded paper sheets are introduced at the receiving end, causing the folded paper sheets to be pushed toward the accumulating end of the stacking table. In an embodiment, the adjustment end may be attached between the stacking arm and the adjustment bar so that upon movement of the adjustment bar from the small size sheet indicia to the large size sheet indicia the stacking arm causes the roller to move from the receiving end of the stacking table to the accumulating end of the stacking table in order to compress the folded paper sheets at the accumulating end. In an embodiment, the stacking table may include a belt for moving the folded paper sheets from the receiving end to the accumulating end of the stacking table. In an embodiment, the housing may include a removable plate enclosing a processing area, the plate quickly removable in a two-step process.

In a further embodiment the present invention may provide a stacking arm of a paper folding machine stacking the arm comprising an adjustment mechanism for controlling a stacking arm including a pivot arm pivotally attached to a support arm having a roller mounted thereon positioned adjacent a stacking table and an adjustment arm attached to the pivot arm for automatically mechanically controlling the stacking arm so that when a large size sheet is folded and output to the stacking table, the stacking arm is automatically adjusted to a position on the stacking table corresponding to a length of the large size sheets as folded. In an embodiment, the adjustment arm may be attached to an adjustment bar disposed within a fold table and the adjustment bar is adjustable in order to fold the large size sheets. In an embodiment, the adjustment bar is adjustable to fold small size sheets.

In an embodiment, the adjustment arm may be slidingly attached to a track of the pivot arm. In an embodiment, the stacking arm may further comprise a bearing slider mounted in the track and the adjustment arm is pivotally attached to the bearing slider. In an embodiment, the adjustment arm is attached to a paper stop box at an end of the adjustment arm opposite the bearing slider and the paper stop box is attached to the adjustment bar. In an embodiment, the pivot arm may be pivotally attached to a housing of a paper folding machine. In an embodiment, a pair of rollers may be mounted to the support arm. In an embodiment, the stacking arm may further comprise a quick release pin inserted through the pivot arm and support arm at a pivot joint for quickly detaching the pivot arm from the support arm upon removal of the release pin from the pivot joint.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its constructions and operation, and many of its advantages should be readily understood and appreciated.

DETAILED DESCRIPTION

Figure 1A:
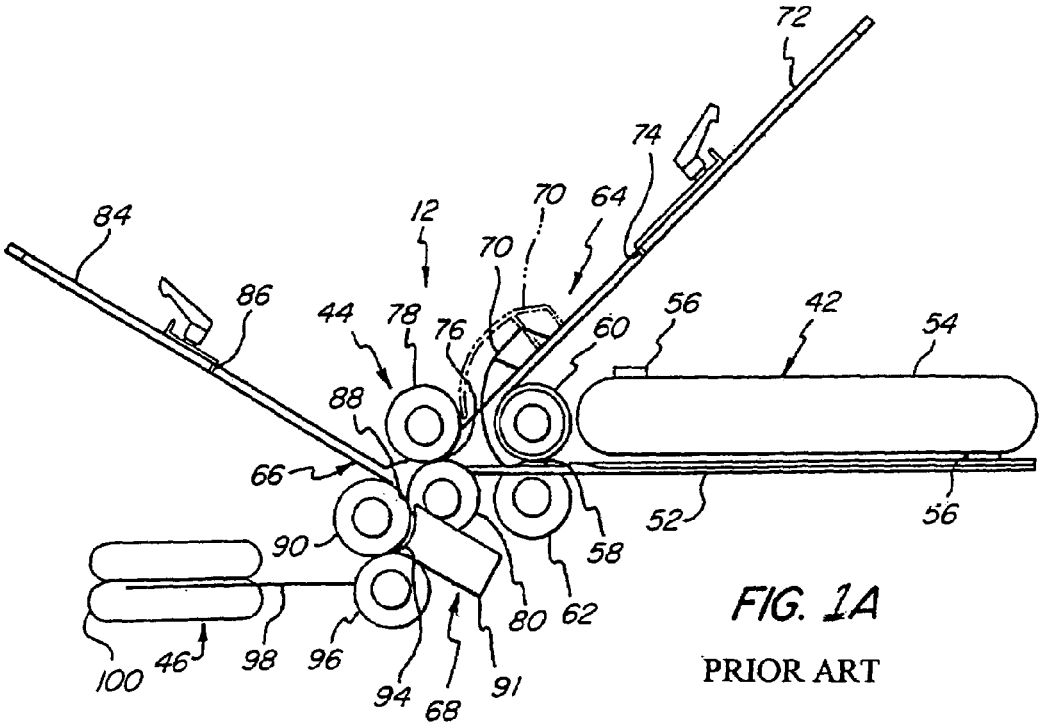
FIG. 1A PRIOR ART
FIG. 1A is a fragmentary, diagrammatic, side elevational view of a prior-art folding apparatus set up to create a Z-folded product.
Figure 1B:
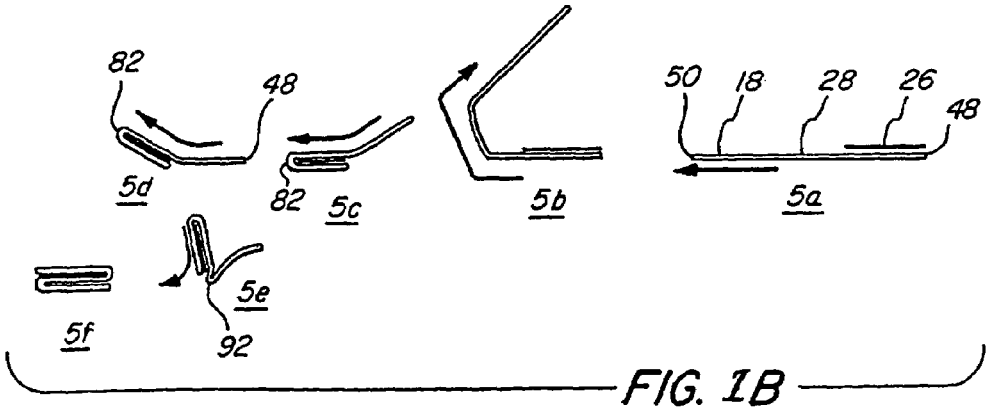
FIG. 1B PRIOR ART
FIG. 1B is a schematic diagrammatic view of the product as it is processed through the apparatus of FIG. 1A to create a Z-folded product.
Figure 2A:
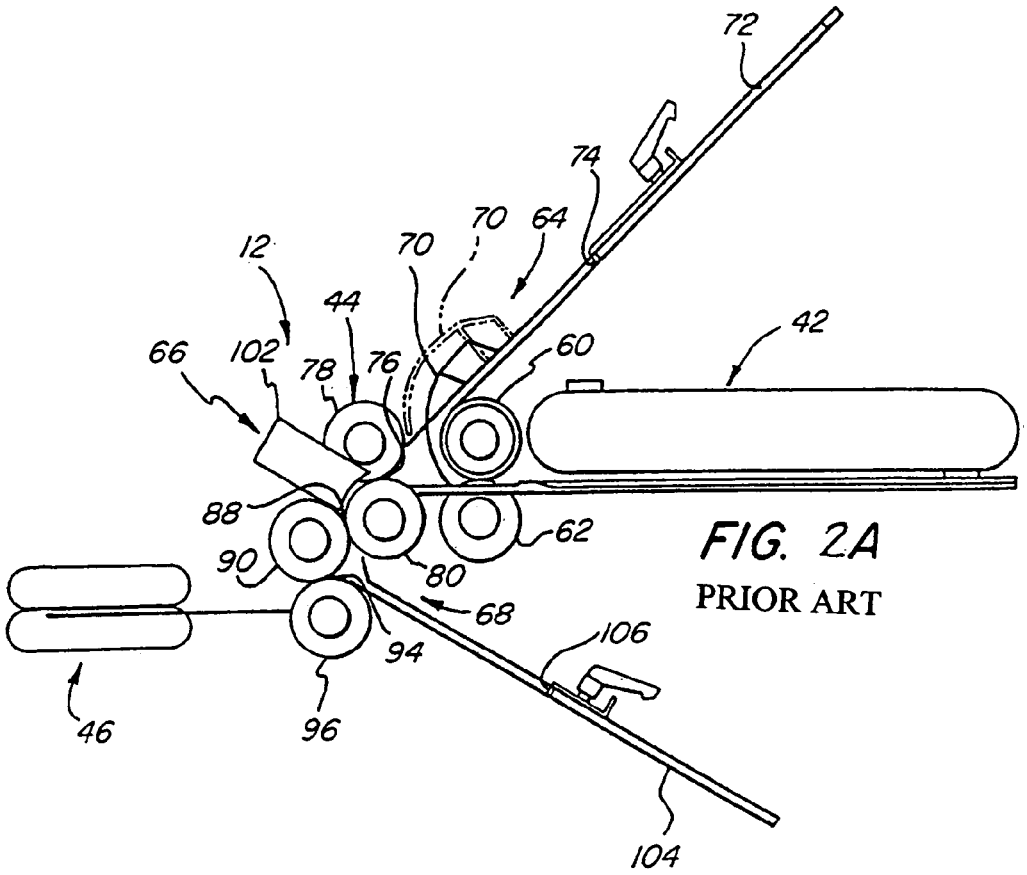
FIG. 2A PRIOR ART
FIG. 2A is a view similar to FIG. 1A, with the application set up to create a C-folded product.
Figure 2B:
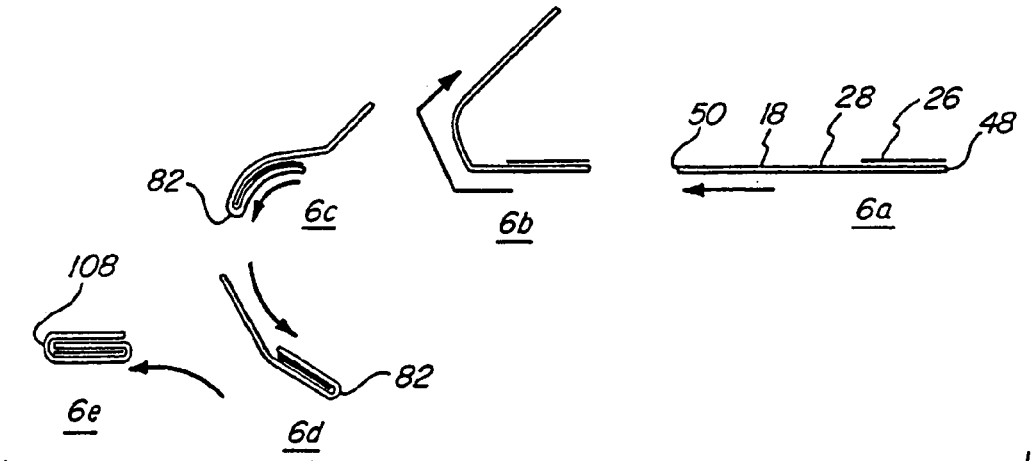
FIG. 2B PRIOR ART
FIG. 2B is a schematic diagrammatic view of the product as it is processed through the apparatus of FIG. 2A to create a C-folded product.
Figure 3A:
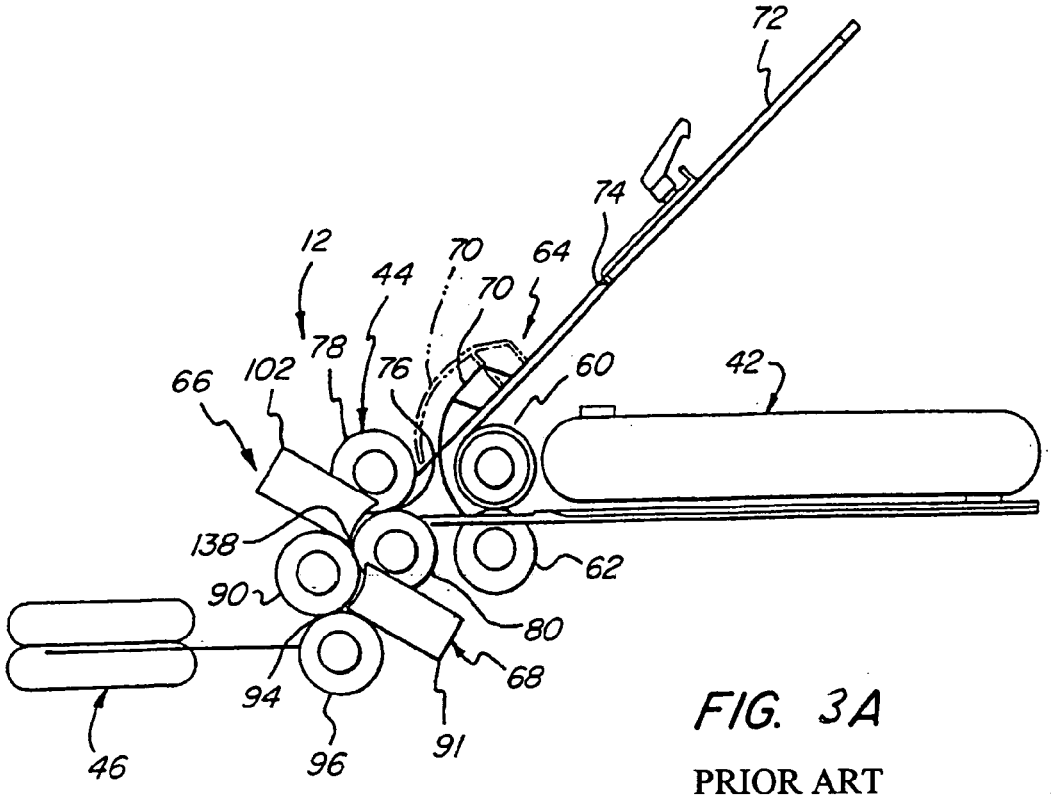
FIG. 3A PRIOR ART
FIG. 3A is a view similar to FIG. 1A with the apparatus set up to create a half-folded product utilizing a thru feed path.
Figure 3B:
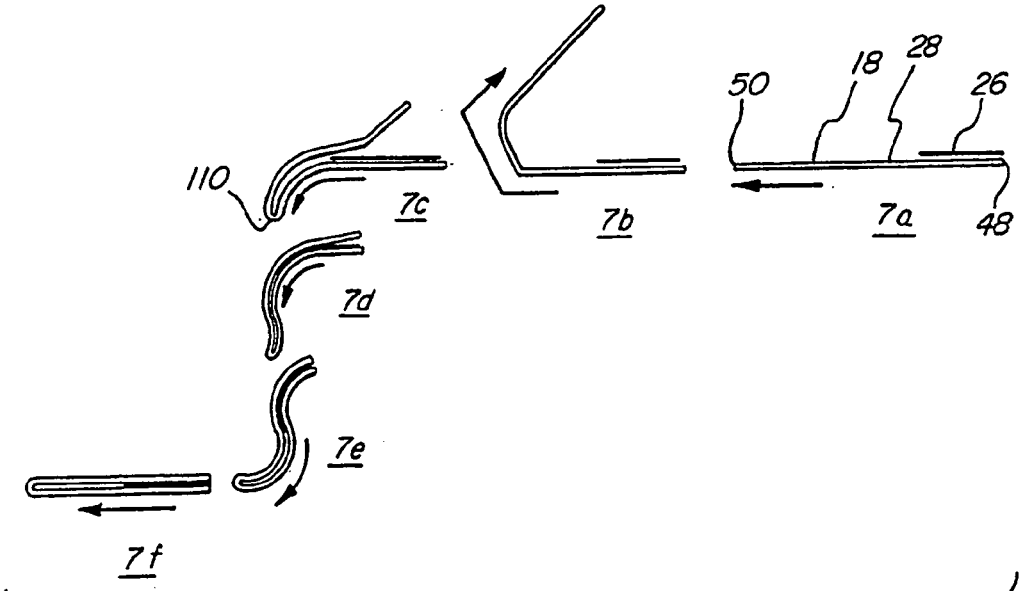
FIG. 3B PRIOR ART
FIG. 3B is a schematic diagrammatic view of the product as it is processed through the apparatus of FIG. 3A to create a half-folded product.
Figure 4A:
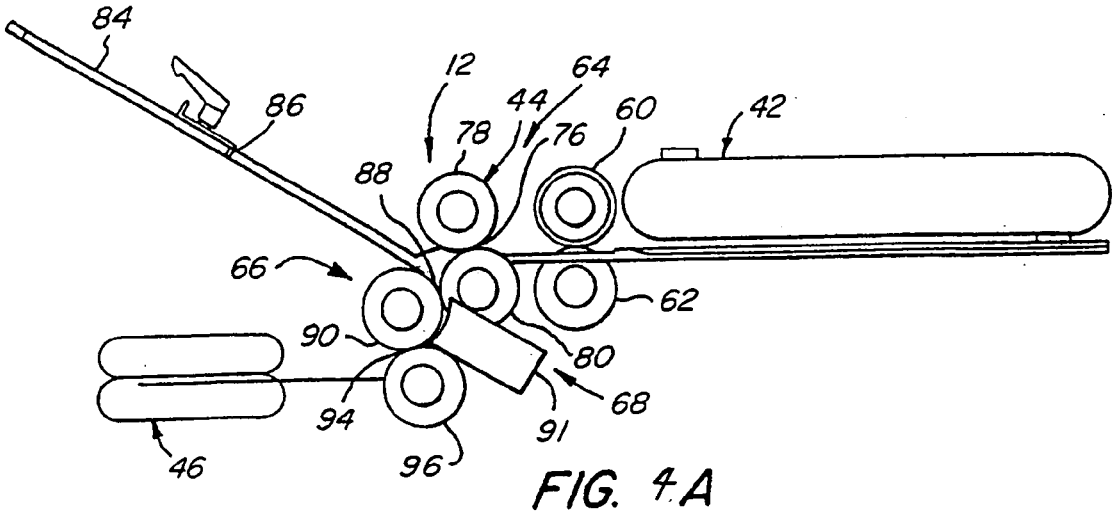
FIG. 4A PRIOR ART
FIG. 4A is a view similar to FIG. 1A with the apparatus set up to create a half-folded product utilizing a downwardly directed fold path.
Figure 4B:
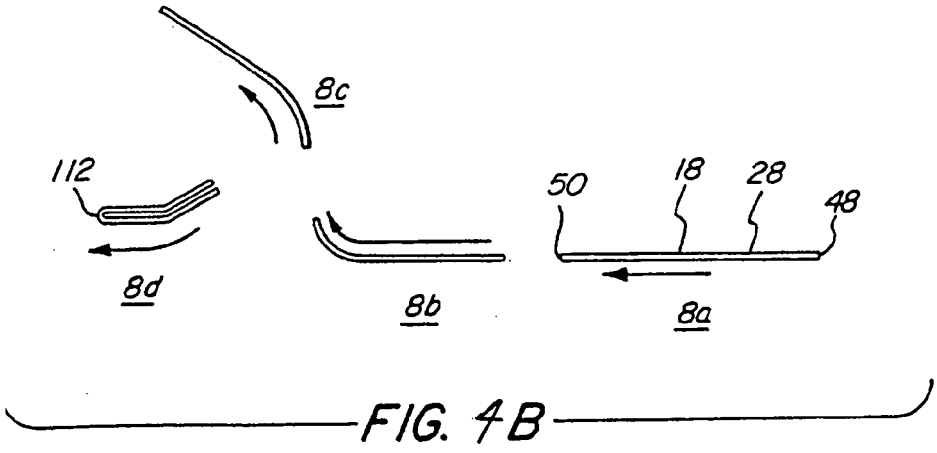
FIG. 4B PRIOR ART
FIG. 4B is a schematic diagrammatic view of the product as it is processed through the apparatus of FIG. 4A to create a half-folded product.
Figure 5A:
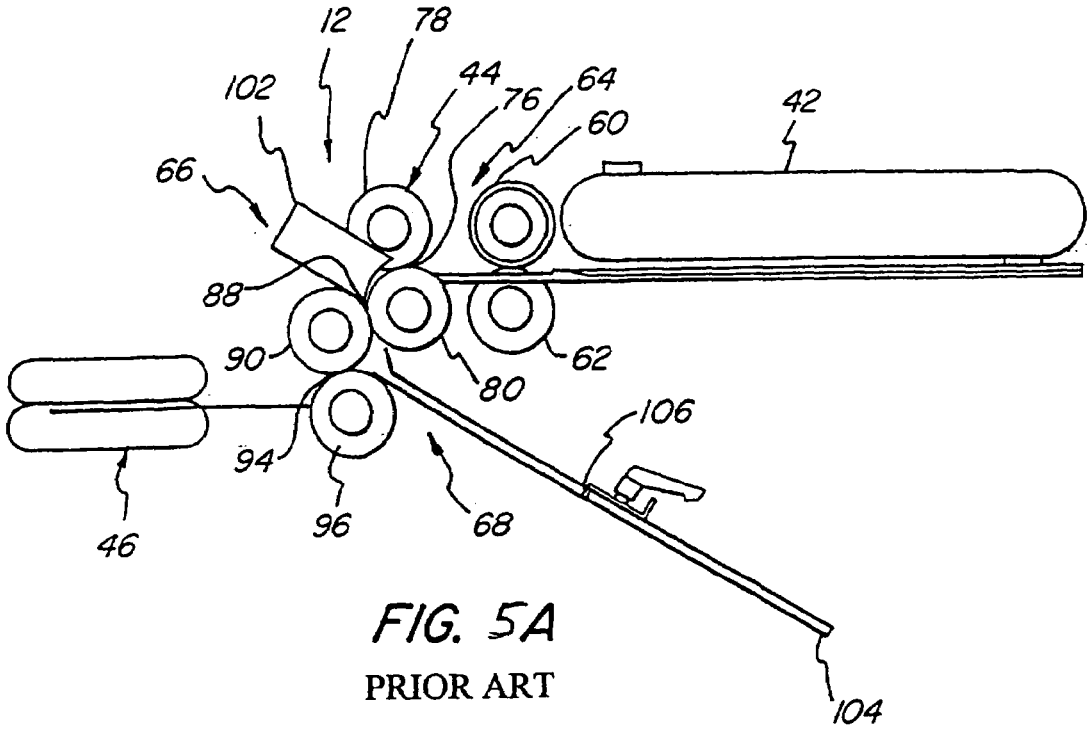
FIG. 5A PRIOR ART
FIG. 5A is a view similar to FIG. 1A with the apparatus set up to create a half-folded product utilizing a upwardly directed fold path.
Figure 5B:
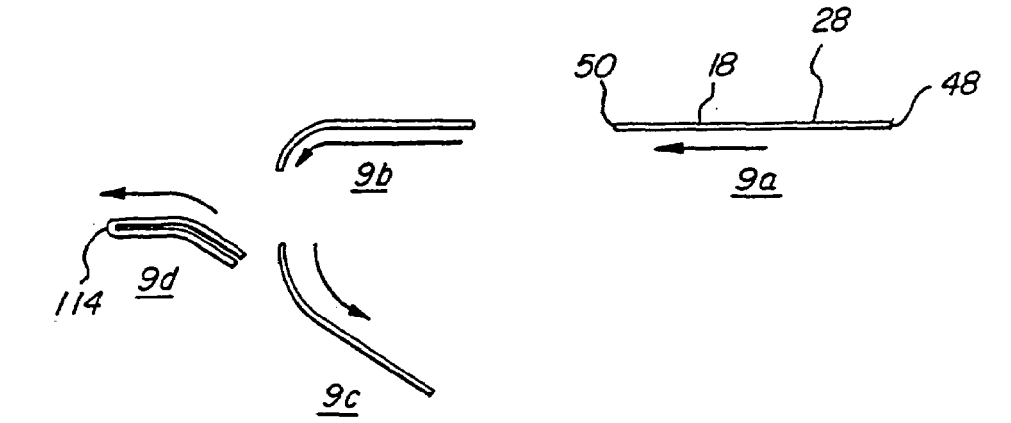
FIG. 5B PRIOR ART
FIG. 5B is a schematic diagrammatic view of the product as it is processed through the apparatus of FIG. 5A to create a half-folded product.
Figure 6:
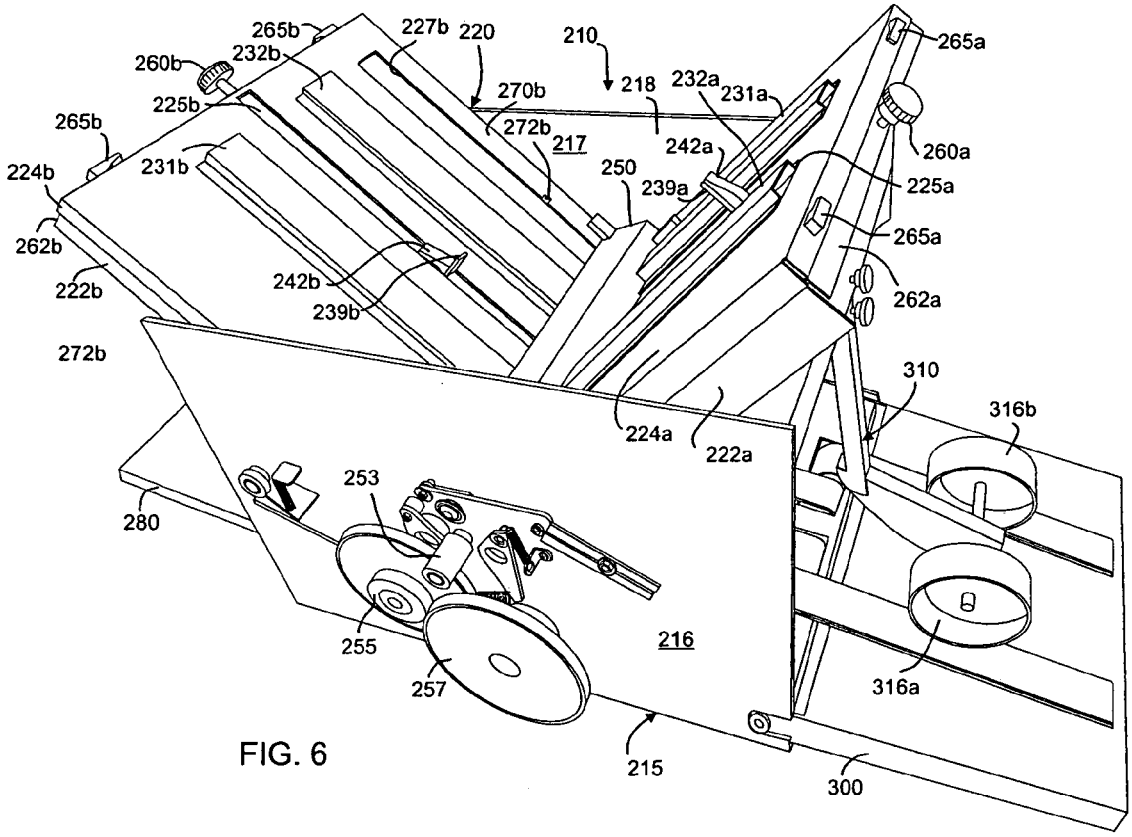
FIG. 6 is a perspective view of a folding machine of the present invention.
Figure 7:
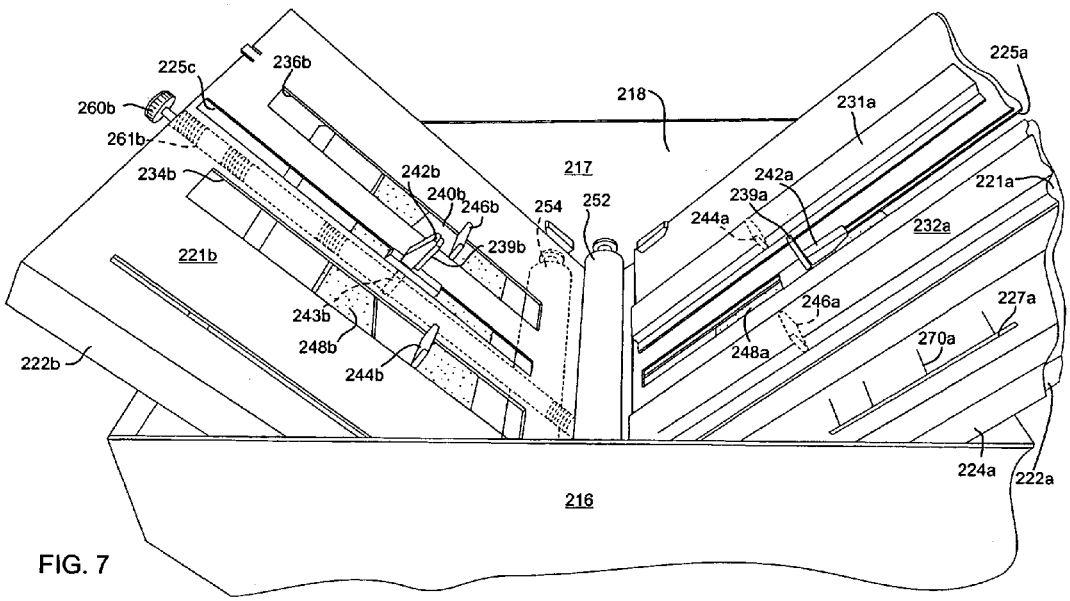
FIG. 7 is an enlarged perspective view of the folding machine of FIG. 6 showing an upper plate of the folding machine removed.

The present invention is described with respect to FIGS. 6–13. Like numerals for like elements are used throughout all FIGS. 6–13. A paper folding machine 210 is provided having a housing 215 including a first sidewall 216 and a second sidewall 217. The housing 215 forms an upper opening 218. A V-shaped upper split table 220 provides a paper processing area that is disposed between the first sidewall 216 and second sidewall 217 and is accessible through the upper opening 218. The split table 220 is formed by lower fold plates 222*a, b* and upper removable plates 224*a, b*. In an embodiment, a first upper removable plate 224*a* is disposed on first lower fold plate 222*a* forming a right side work area, pocket or chamber 221*a* and a second upper removable plate 224*b* is disposed on a second lower fold plate 222*b* forming a left side work area, pocket or chamber 221*b* (FIG. 7).

First slots 225*a, b* are formed in the upper plates 224*a, b*. First slot 225*c* (FIG. 7) is formed in the lower plate 222*a, b*. Second slots 227*a, b* are also formed in the upper plates 224*a, b*. First chutes 231*a, b* are formed on one side of the slot 225*a, b* and second chutes 232*a, b* are formed on the opposite side of the slot 225*a, b*. Corresponding to the chutes 232*a, b* and formed on the lower fold plates 222*a, b* are first channels 234*a, b* and second channels 236*a, b*. Disposed behind the lower fold plate 222*a, b* are paper stops or adjustment bars 240*a, b* that in an embodiment are each mounted on an adjustment rod, explained further below. Each paper stop 240*a, b* includes an adjuster 242*a, b* that protrudes through slots 225*a, b*, respectively. Fingers 244*a, b*, 246*a, b* are disposed on the paper stop 240*a, b* and protrude through the channels 234*a, b*, and 236*a, b*, respectively. In an embodiment, the fingers 244*a, b*, 246*a, b* are integrally formed with the major surface of the paper stop 240*a, b* and protrude at a right angle therefrom. In an embodiment, the paper stop 240*a, b* may be formed of a polymer material.

The adjuster 242*a, b*, in an embodiment, is a lever which may be moved between a locked condition and an unlocked condition. The adjuster lever 242*a, b* may be grabbed between an operator's fingers and in the unlocked condition may slide the paper stop 240*a, b* along the plates 222*a, b*, and 224*a, b* so that the fingers 244*a, b*, 246*a, b* simultaneously move along channels 234*a, b*, 236*a, b*. In an embodiment, each adjuster 242*a, b* includes a lever and a tab 239*a, b* mounted to the paper stop 240*a, b*. The adjuster lever 242*a* pivots between a locked condition, parallel to the plane of the paper stop (as shown in FIG. 7) and an unlocked condition, perpendicular to the plane of the paper stop and parallel to the tab (as shown in FIG. 6 and also perpendicular lever 242*b* in FIG. 7). An actuator 243*b* (FIG. 7) attached to the lever 242*b*, engages an adjustment rod 261*a, b* when the lever 242*b* is in a locked condition in order to lock the paper stop 240*a, b* in a predetermined position along the adjustment rod 261*a, b*. Pivoting the lever 242*a, b* to the unlocked condition causes the actuator 243*b* to release from the adjustment rod 261*a, b*, so that the paper stop 240*a, b* may be slid up and down along the adjustment rod 261*a, b* and along the slots 225*a, b, c*. In an embodiment, when the lever 242*a, b* is in its unlocked, perpendicular condition, a user may simultaneously grasp the lever 242*a, b* and tab 239*a, b* between his/her fingers in order to adjust the paper stop 240*a, b* along the lower fold plates 222*a, b*.

During operation of the folding machine, paper may abut the fingers 244*a, b*, 246*a, b* of the paper stop 240*a, b* at predetermined locations, arrived at by moving the adjuster 242*a, b*. The fingers 244*a, b*, 246*a, b* include stop surfaces that act to deflect, buckle or stop paper sheets circulating in the folding machine 210 in order to form a nip at the side of the sheet opposite the stop surface, in order to fold the sheets at predetermined locations and fold types. In an embodiment, paper sheets are processed first in left pocket 221*b* and secondly in right pocket 221*a*. The folds are formed and paper sheets are processed generally as discussed above for FIGS. 1A–5B. In an embodiment, the paper stop 240*a, b* may have both a folding function and an adjustment function. In an alternate embodiment the paper stop 240*a, b* may only act to fold paper sheets and a separate component may act as an adjustment bar for adjusting the position of the paper stop. A sound deadening medium 248*a, b* such as a sound deadening paper or acoustic foam is located under the lower fold plates 222*a, b*.

A roller cover 250 is located between the plates 222*a, b*, 224*a, b* and in an embodiment, is attached to the upper plate 224*b*. Located under the roller cover (FIG. 7) is a feeding mechanism, for example, a main roller 252. A main roller gear 253 (FIG. 6) is attached to the main roller 252. A secondary roller 254 is located adjacent to the main roller 252 and a secondary roller wheel 255 is attached thereto. As well, a tertiary roller 256 (FIG. 10) is provided and includes a tertiary roller gear 257 (FIG. 6). These rollers act to propel the paper sheets between the fold plates 222*a, b*, 224*a, b* and to form nips in order to fold the paper sheets.

Figure 10:
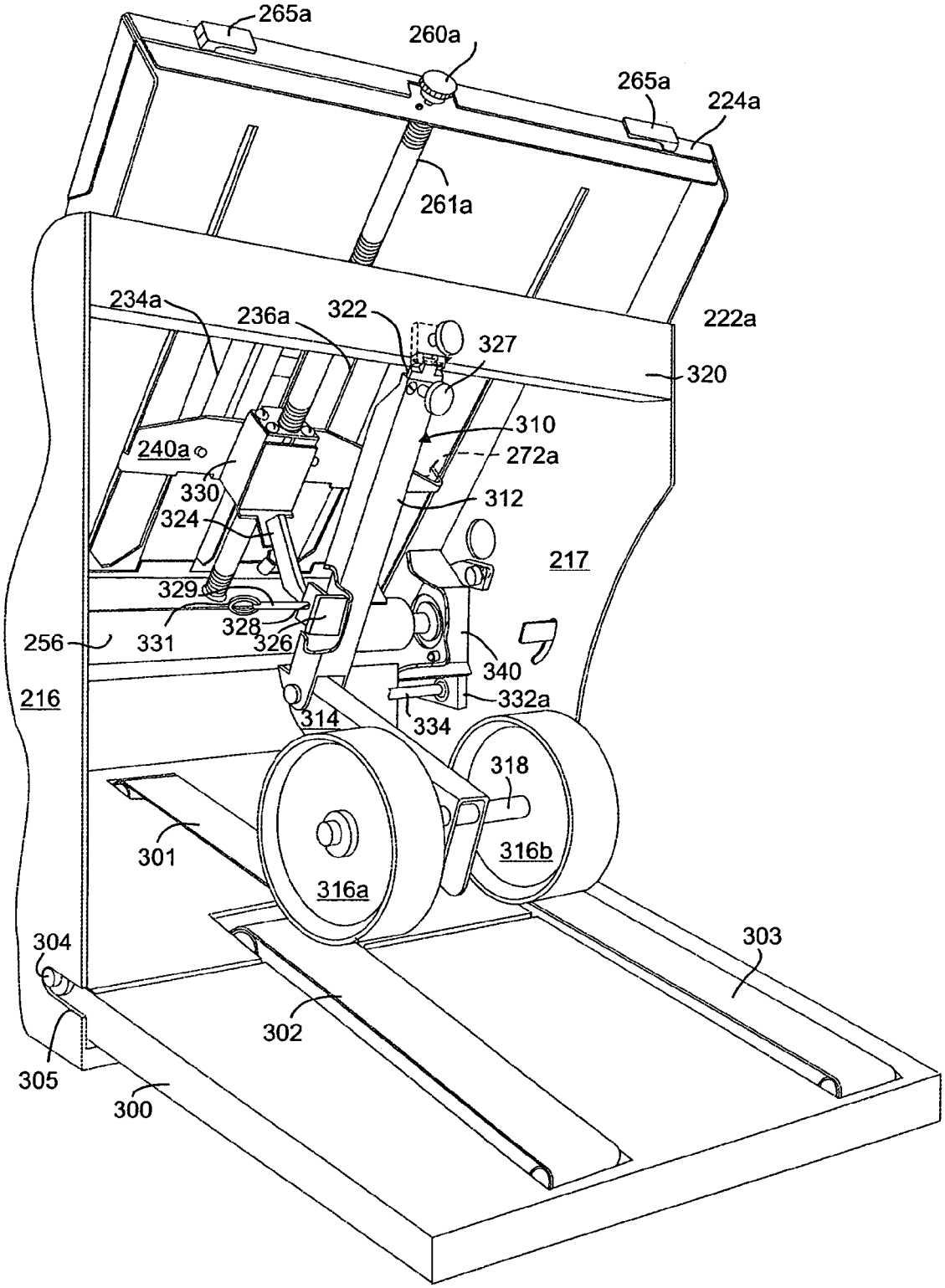
FIG. 10 is a fragmentary, perspective view of the folding machine of FIG. 6 showing the stacking plate and stacking arm of the folding machine.

An adjustment knob 260*a, b* is mounted at the terminal end of each upper plate 224*a, b*. Whereas the adjusters 242*a, b* provide for large or gross adjustment of the paper stops 240*a, b*; the adjustment knobs 260*a, b* provide for fine adjustment of the paper stops 240*a, b*. In an embodiment, by rotating the knobs 260*a, b* either clockwise or counterclockwise the paper stops 240*a, b* may be adjusted by millimeter increments to adjust for different paper weights/bond types. Each adjustment knob 260*a, b* is attached to adjustment rods 261*a, b*, respectively, upon which the paper stop 240*a, b* is mounted. In an embodiment, the adjustment rod 261*a, b* is mounted adjacent to the lower fold plate 222*a, b* and extends between the terminal edge 262*a, b* and proximal edge 263*a, b* of the lower fold plates 222*a, b* (as shown in FIG. 10). In an embodiment, the paper stop includes a means for threadingly receiving threaded portions of the adjustment rod

261*a, b* so that upon rotation of the knob 260*a, b,* the paper stop 240*a, b* will be moved incrementally either up or down along the lower fold plate 222*a, b.*

A quick coupling mechanism, for example, attachment levers 265*a, b* are also provided at the terminal end of the upper plates 224*a, b.* The attachment lever 265*a, b,* in an embodiment, is a pivoting lever which has a locked and unlocked condition. The upper plates 224*a, b* may be quickly and easily mounted on the lower fold plates 222*a, b* and secured thereto by locking the attachment levers 265*a, b.* In an embodiment, each attachment lever 265*a, b* has a swell latch having an expander 266*b* (see FIG. 8) that latches within an aperture 267*b* at the terminal edge 262*b* of each lower fold plate 222*a, b* when the pivoting lever 265*a, b* is in its locked condition positioned horizontal to the edge of the upper plate 224*a, b* (as shown in FIGS. 6, 8, 10). To unlatch the attachment lever 265*a, b* and move it to its unlocked condition, a pivot lever 265*a, b* is grasped between a user's fingers and moved to a position vertical to the edge 262*a, b* (FIG. 6) of the upper plate 224*a, b,* which causes an expander 266*b* (FIG. 8) to unlatch from an aperture 267*b* formed at the terminal edge 262*b* of the lower fold plate 222*b,* so that upon continued pulling on the pivot lever 265*a, b* by a user's fingers, the upper plate 224*a, b* may be quickly removed from the lower fold plate 222*a, b.* For example, each expander 266*b* may include a resilient sleeve 268*b* having a hook 269*b* (FIG. 8) inside so that the sleeve 268*b* is caused to expand by movement of the hook 269*b* when the attachment lever 265*a, b* is in its locked condition. The sleeve 268*b* may be contracted by movement of the hook 269*b* when the attachment lever 265*a, b* is in its unlocked condition. Thus, for each attachment lever 265*a, b* a two-step removal process is provided, consisting of 1) unlocking the adjustment lever 265*a, b* and 2) removing the upper plate 224*a, b* from the lower plate 222*a, b.* Other known fasteners may also be used for the adjustment lever 265*a, b.* Thus, the present invention provides for upper plates 224*a, b* that are quickly and easily removable and reattachable to the folding machine 210.

In an embodiment, the upper plate 224*a, b* contains few components and is very lightweight. In an embodiment, each upper plate 224*a, b* is made of metal and weighs less than 5 lbs. Thus, when repair of the machine 210, is required, the upper plates 224*a, b* can be quickly and easily removed so that the main roller 252 and the paper stops 240*a, b* may be exposed. These are areas where cleaning is required and paper jams may frequently occur that can be quickly and easily rectified with the construction of the present invention. The construction of the plates 222*a, b,* 224*a, b* having slots 225*a, b, c,* 227*a, b* allow for access to the adjuster 242*a, b* and indicator 272*a, b* from above the upper plates 224*a, b,* even though such structures are not carried by the upper plates 224*a, b.* Because these elements 242*a, b,* 272*a, b,* and the paper stops 240*a, b* are supported by the lower fold plate 222*a, b*; the upper plate 224*a, b* is lightweight and can be quickly and easily removed. This construction also allows for the lower plates 222*a, b,* in an embodiment, to be welded to the housing 120 and side walls 216, 217 to provide for a very rigid folding machine structure that allows for the processing of paper sheets with precise, square folds.

Figure 8A:
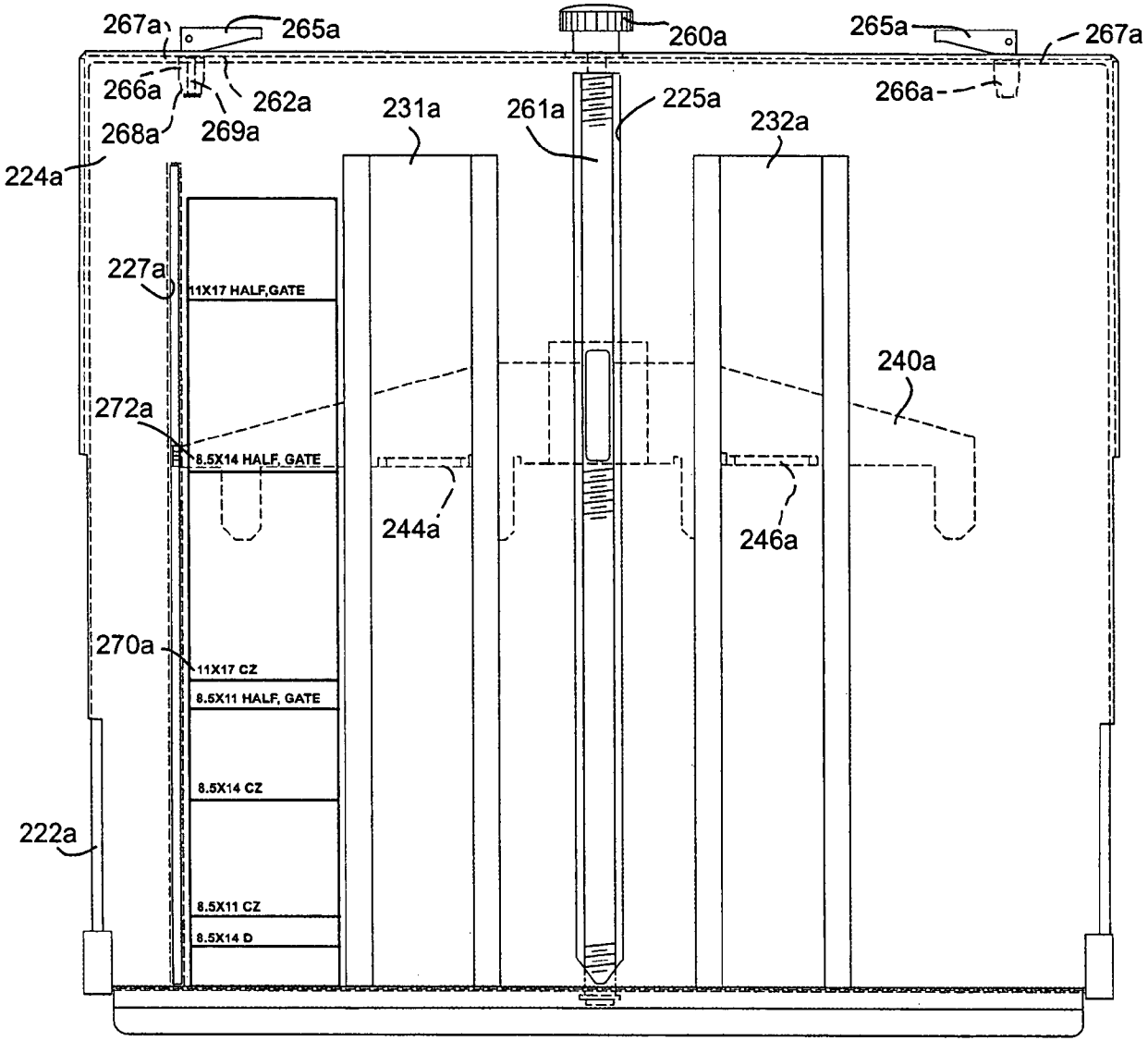
FIG. 8A is a plan view of a first plate of the folding machine of FIG. 6.
Figure 8B:
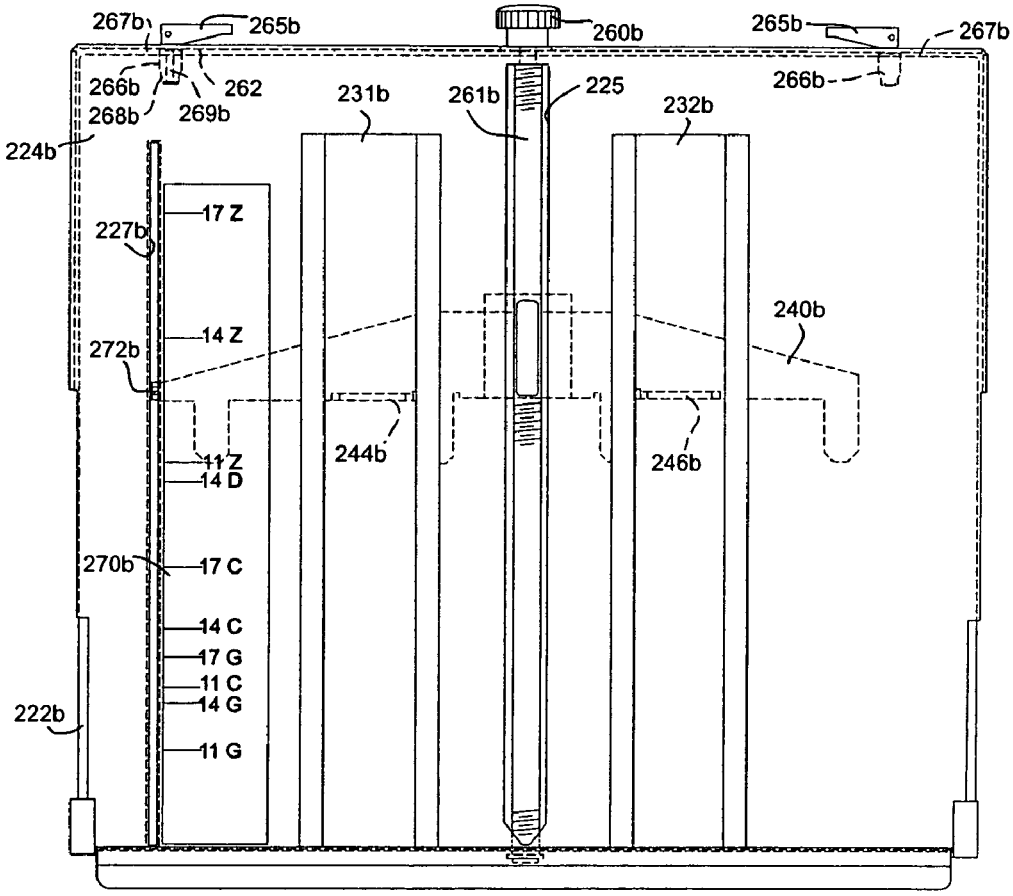
FIG. 8B is a plan view of a second plate of the folding machine of FIG. 6.

As shown in FIGS. 7, 8A and 8B the upper plates 224*a, b* include type of fold indicia and paper size indicia 270*a, b.* In an embodiment, the type of fold and paper size indicia 270*a, b* are numbers and letters printed on the face of the upper plate 224*a, b* adjacent the slots 227*a, b.* In an embodiment, the indicia may be printed directly onto the plate or attached by a label or decal. Protruding through the slots 227*a, b* and adjacent the indicia 270*a, b* are indicia indicators 272*a, b* which, in an embodiment, are attached to the paper stop or adjustment bar 240*a, b.* Upon movement of the paper stop 240*a, b,* the indicia indicator 272*a, b* simultaneously moves and provides an indication of the type of fold or size of fold that the location of the paper stop 240*a, b* will provide in that specified position. For example, as shown in FIG. 8B, the top indicia "17 Z" indicates that a Z-type fold with 17 inch paper will be provided for, when the paper stop 240*b* is moved to the upper most position. For example, the indicia 270*b* indicate "14 Z" (Z-type fold with 14 inch paper), "11 Z" (Z-type fold with 11 inch paper), "14 D" (D-type fold with 14 inch paper), "17 C" (C-type or Correspondence fold with 17 inch paper), "14 C" (Correspondence fold with 14 inch paper), "17 G" (G-type fold with 17 inch paper), "11 C" (Correspondence fold with 11 inch paper), "14 G" (G-type or Gate fold with 14 inch paper), and "11 G" (G-type fold with 11 inch paper). Other indicia and other sequencing of the indicia may be provided. In an embodiment, the upper left side fold pocket 221*b* and plates 222*b* and plates 224*b* are not used to provide half folds. In order to adjust the machine to provide half folds the paper stop 240*b* is moved to the bottom of the plate in order to act as a deflector from the first or left side fold pocket 221*b* so that paper sheets go directly to the second or right side fold pocket 221*a* of the fold plate 222*a* (FIG. 8A) where half folds may occur. In an embodiment, the indicia 270*a* of the upper plate 224*a* will include half fold and gate fold indicia for 17", 14" and 11" size sheets, a D-type or double parallel fold position for 14" sheets as well as the indicia 270*a,* described above for C-type and Z-type folds. It is noted that the arrangement of the indicia 270*a* on the first removable plate 224*a* is organized differently than the indicia 270*b* on the second removable plate 224*b* because the position of the paper stop 240*a, b* in order to accomplish such fold types varies from the right side fold pocket 221*a* to the left side fold pocket 221*b.*

Figure 9:
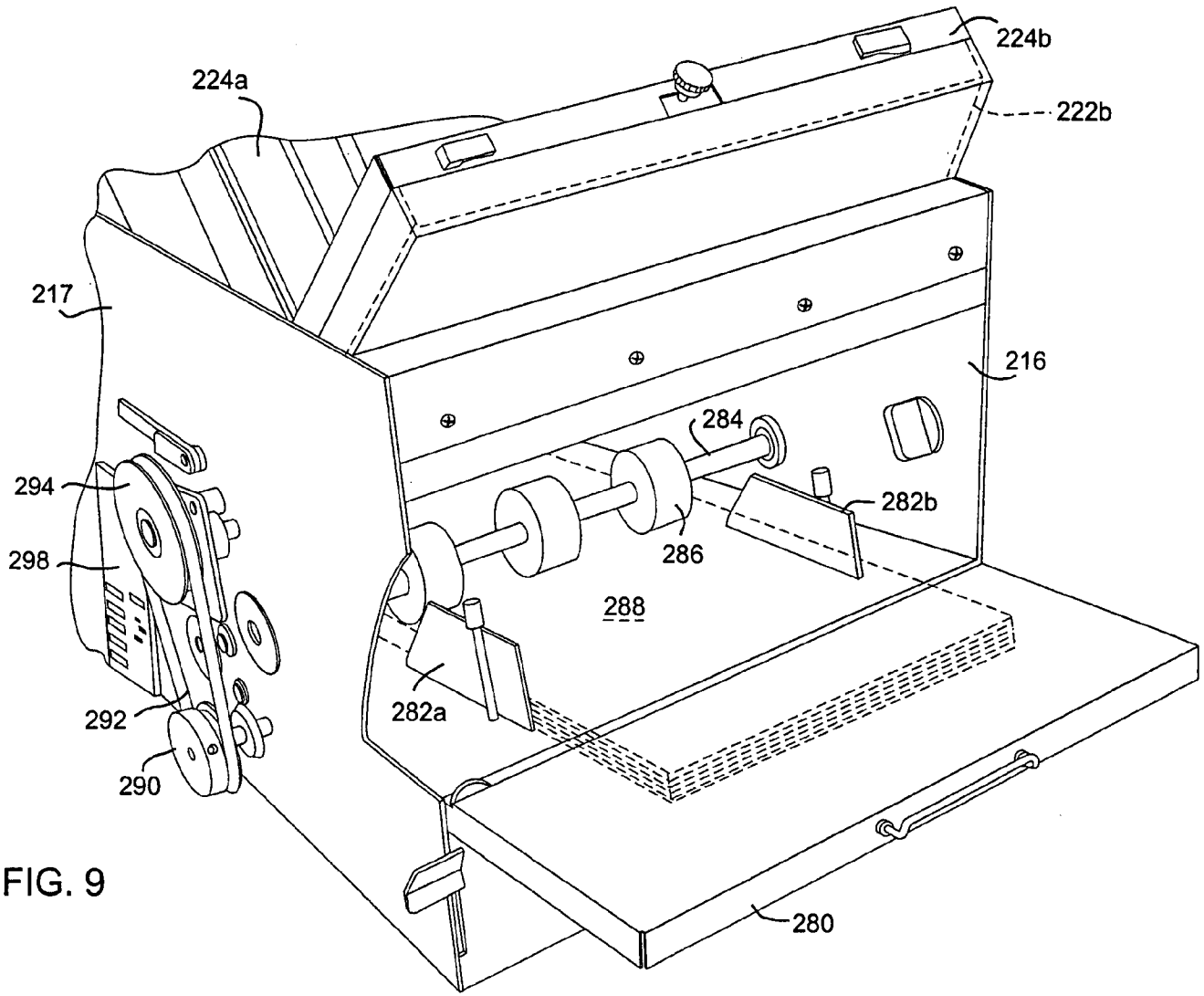
FIG. 9 is a fragmentary, perspective view of the folding machine of FIG. 6 showing the paper supply plate of the folding machine.

Turning to FIG. 9, a supply plate or input table 280 provides a paper input feeding or receiving area having paper width guides 282*a, b.* In an embodiment, the supply plate 280 may be adjustable upward and downward. Mounted between the first and second sidewall 216, 217 is a paper supply roller 284. The roller 284 includes wheels 286 for injecting paper sheets 288 into the fold machine 210. Protruding from the second sidewall 217 are a power gear 290, a drive mechanism 292, a central drive gear 294 and a control panel 298 for controlling the operation of the folding machine 210.

Turning to FIG. 10, a stacking plate or table 300 provides a paper output area including a pair of first belts 301 (one shown), a pair of second belts 302 and 303 for pulling paper from the folding machine 210 and for stacking folded sheets on the stacking plate 300. The stacking plate 300 is pivotally mounted between the sidewalls 216, 217 via pin 304 received in channel 305. In an embodiment, a stacking arm 310 is provided which includes a mechanical link including a pivot arm 312 and support arm 314. Stacking rollers 316*a, b* are attached to the support arm 314 by a rod 318. The stacking arm 310 operates in order to help compress the finished folded sheets (not shown) and to help stack them on the stacking plate 300. The stacking arm 310 is automatically adjusted in order to position the rollers 316*a, b* in the proper position on the stacking plate 300 according to the size of the paper being ejected from the machine 210 and according to the positioning of the paper stop or adjustment bar 240*a, b.*

A housing frame 320 is provided between the first sidewall 216 and second sidewall 217. Attached to the housing frame 320 is a hinge 322. Attached to the hinge 322 is the pivot arm 312. Within the pivot arm is provided a slide track. In an embodiment, a sliding or adjustment arm 324 is attached to the pivot arm 312 via a bearing slider 326 mounted in the slide track of the pivot arm 312 providing a pivot joint 328. At the end opposite the pivot joint 328, the sliding arm is attached to a paper stop box 330. In an embodiment, the paper stop box 330 includes threaded bores which receive threaded portions of the rod 261 a therethrough. The paper stop box 130 is also attached to the paper stop or adjustment bar 240*a*.

Figure 11:
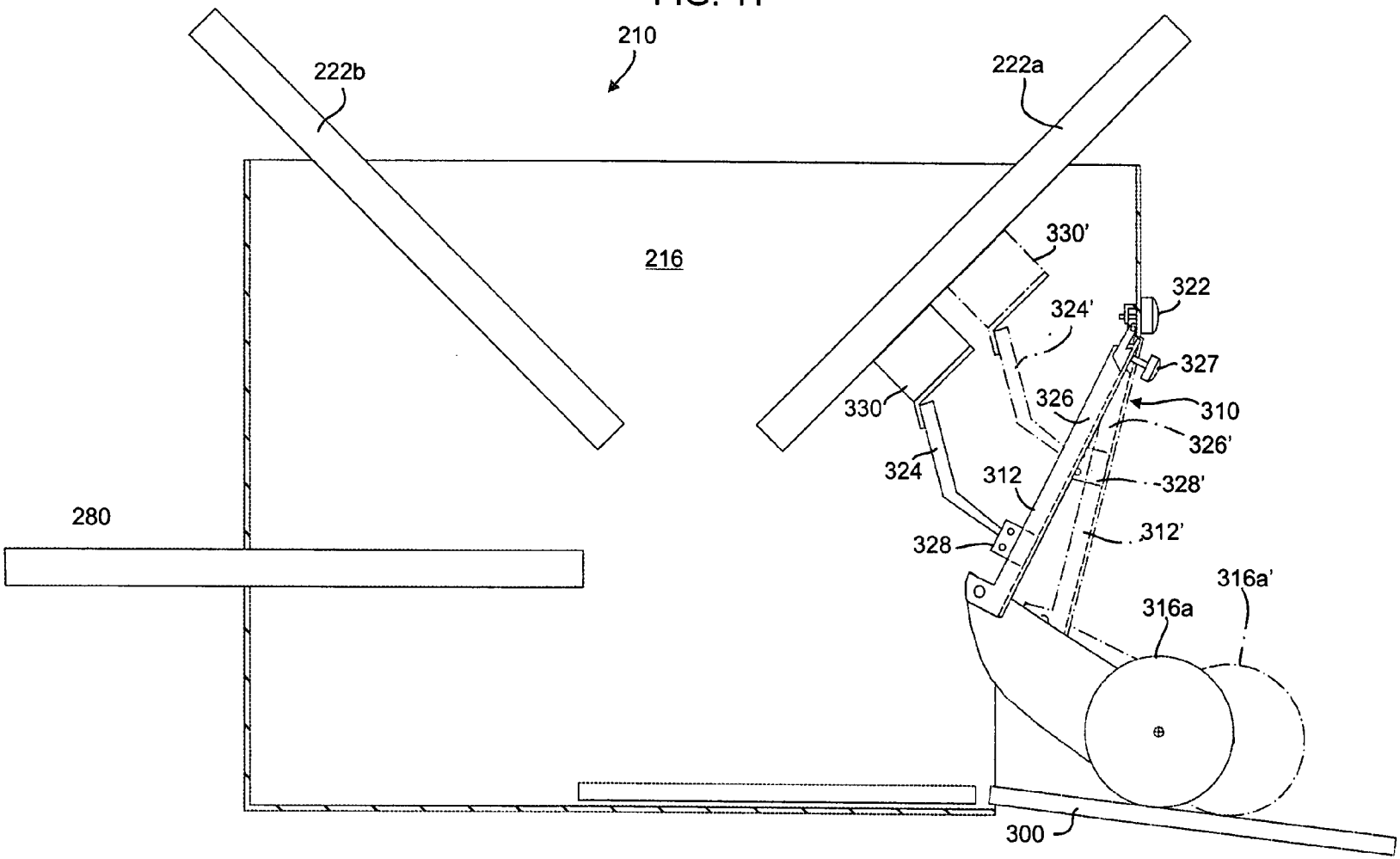
FIG. 11 is a side elevational diagrammatic view of the folding machine of FIG. 6 depicting multiple positioning of the stacking arm.

Operation of the stacking arm 310 will be discussed with respect to FIGS. 10 and 11. When the adjustment bar 240*a* is adjusted via the adjuster 242*a, b* (FIG. 6, 9) discussed above, it will simultaneously move the paper stop box 330 up and down along the rod 260*a,* which will simultaneously cause the sliding arm 324 to move. Movement of the sliding arm 324, 324' will cause the bearing slider 326 to slide along the track formed in the pivot arm 312 which will cause the pivot arm 312, 312' to pivot. The stacking arm 310 may be moved inward so that the pivot arm 312 is positioned towards tertiary roller 256 and outward so that the pivot arm 312' is positioned towards the stacking plate 300. Such pivoting of the pivot arm 312, 312' causes the support arm 314, 314' to be in an inward position 314 and an outward position 314' that simultaneously moves the roller 116*a,* closer in towards first belt 301 at a receiving end of the stacking table 300 or to a position 316*a'* further out on the stacking table 300 towards its terminal end or accumulating end. (Although FIG. 11 only depicts two positions of the stacking arm 310, it is to be understood that multiple positions may be provided during continuous movement of the arm 310.)

For example, when a small sheet or small fold type is requested, such as "8.5×14 D" (small size sheet indicia), as shown on FIG. 8A, the adjustment bar 240*a* is located towards the bottom of the plate 224*a.* As shown in FIG. 10, this position will draw the pivot arm 312 closer into the machine, towards the tertiary roller 256. Simultaneously, the stacking rollers 316*a, b* will also be moved inward toward the receiving end of the stacking table 300, in order to be positioned to receive the shorter "8.5×14 D" type sheets exiting the machine on the first belt 301. When a larger type fold or larger sheet size is being processed by the machine, the adjustment bar 240*a,* will be positioned towards the upper terminal end of the upper plate 224*a,* for example, at the "11×17 Half, Gate" designation (large size sheet indicia), as shown on FIG. 8A. This positioning of the adjustment bar 240*a* will cause the sliding arm 324' to move the pivot arm 312' and the stacking roller 316*a'* outward in order to position the roller 316*a'* further down the stacking plate 300 at the accumulating end where the longer "11×17 Half, Gate" type sheets which will accumulate and be stacked in a shingled orientation on the stacking plate 300. Therefore, it may be understood that when the machine is adjusted for the specified fold types or paper sizes by movement of the paper stop or adjustment bar 240*a,* the stacking arm 310 is also automatically adjusted for the stacking of the specified folded papers when they exit the folding machine and are received and accumulated on the stacking plate 300. Such positioning of the stacking arm 310 and rollers 316*a, b* will provide for neatly shingled, stacked paper sheets on the stacking tray 300.

In an embodiment, the stacking arm 310 may include a quick release 328 so that the arm 310 may be disengaged from the adjustment bar 240*a* and the arm 310 may be operated independently. For example, if a non-standard paper size or paper fold is being processed by the machine 210, it may be desirable to be able to independently set the stacking arm 310 in particular positions on the stacking plate 300, that would not be provided automatically if the arm 310 were attached to the adjustment bar 240*a.* In an embodiment, the pivot joint 328 may have associated with it, a quick release pin 329 inserted through apertures aligned between the sliding arm 324, the pivot arm 312 and the bearing slider 326. A ring 331 attached to the pin 329 may be pulled to quickly remove the pin 329 from the bearing slider 326, pivot arm 312 and sliding arm 324, so that the pivot arm 312 is disengaged and detached from the sliding arm 324. After release of the pin 329, the stacking arm 310 may be positioned independently from the adjustment bar 240*a,* to which the sliding arm 324 is attached. A tension knob 327 may be rotated in order to hold the stacking arm 310 in a desired position after manual adjustment. In an embodiment the pin 329 will be attached to the housing via a tether (not shown), so that the pin 329 cannot be misplaced after removal from the pivot arm 312.

Figure 12:
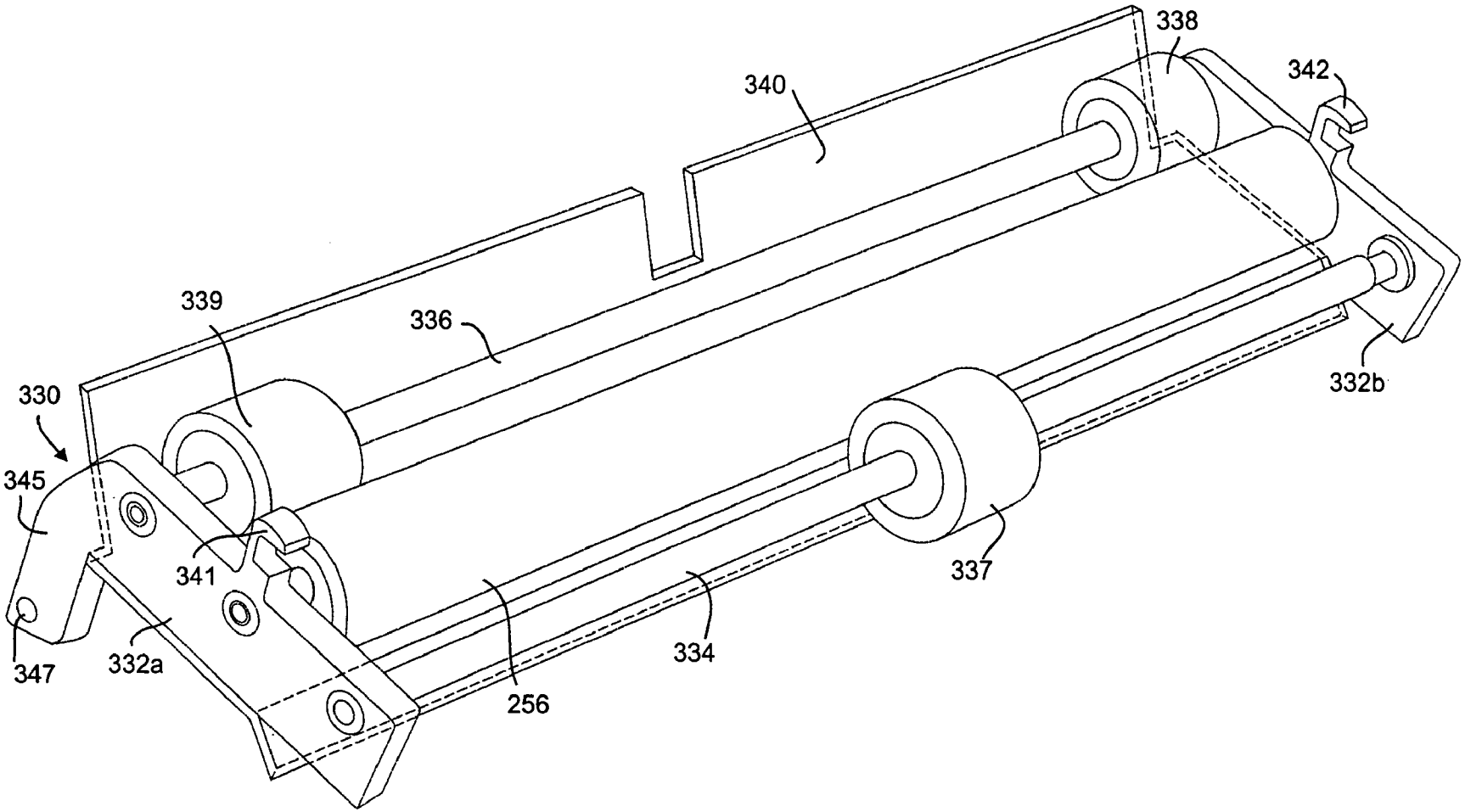
FIG. 12 is an enlarged perspective view of a roller cartridge for use in the folding machine of FIG. 6.

Turning to FIG. 12, a first roller cartridge 330 is disclosed. FIG. 12 depicts an enlarged view of the roller 256, that is also shown in FIG. 10. The cartridge includes a frame 332*a, b* and the tertiary roller 256 is mounted therebetween. A pair of feed rollers 334, 336 are also mounted between the frame 332*a, b* on either side of the tertiary roller 256. Each of the feed rollers 334, 336 include wheels 337, 338, 339 which help to maintain paper sheets in contact with the tertiary roller 256 in order to help the paper sheets feed therethrough. A guide plate 340 is mounted to and extends between the frame 332*a, b* and also helps to guide paper sheets through the rollers 256, 334, 336.

Attached to the frame 332*a, b* are mounting members 341, 342. In an embodiment, the mounting members 341, 342 form U-shaped hooks which help to mount the cartridge 330 within a paper folding machine. As well, each of the frames 332*a, b* includes a tab 345 having an aperture 347 formed therein. In an embodiment, upon mounting of the first cartridge 330 within the paper folding machine 210, the frames 332*a, b* are aligned with the sidewalls 216, 217 so that the mounting members 341, 342 are mounted over posts protruding from the sidewalls 216, 217. Simultaneously, the aperture 347 is aligned with a hole in the wall 216, 217 so that a fastener 348 may be inserted therethrough in order to secure the cartridge 330 within the housing of the paper folding machine. In an alternate embodiment, the cartridge 330 may be mounted permanently within the paper folding machine such as by welding the frame 332*a, b* to the sidewalls 216, 217.

Figure 13:
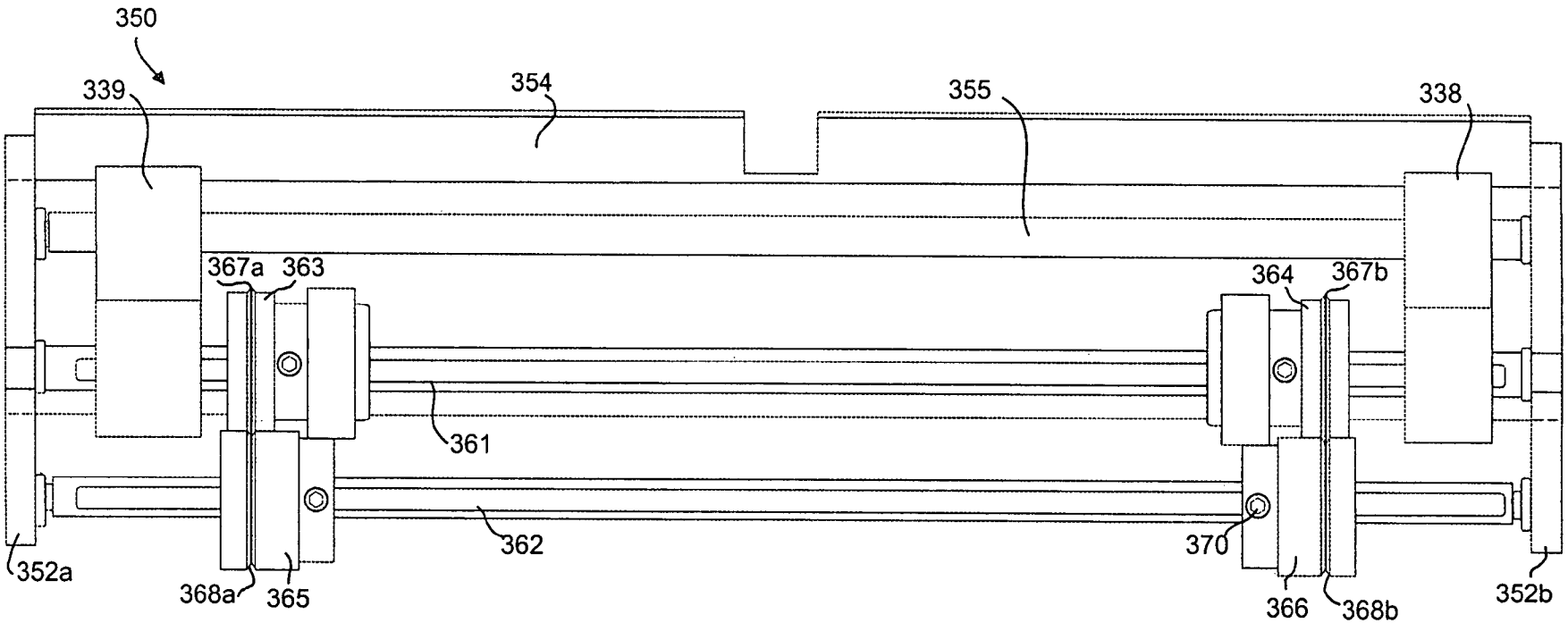
FIG. 13 is an enlarged plan view of an alternate embodiment of a roller cartridge for use in the folding machine of FIG. 6.

Turning to FIG. 13, an alternate embodiment of a second cartridge 350 is shown. The second cartridge 350 includes a frame 352*a, b* and a guide plate 354 which are similar to the frame and guide plate discussed above for FIG. 12. Mounted between the frame 352*a, b* are a feed roller 355 and cutting rollers 361, 362. The first cutting roller 361 includes cutting wheels 363, 364 which engage cutting wheels 365, 366 respectively which are mounted on the second cutting roller 362. In an embodiment, the cutting wheels 363, 364 include annular blades 367*a, b* which engage annular grooves 368*a, b,* respectively, on the corresponding cutting wheels 365, 366. Paper sheets are fed through each of these wheels 363, 364, 365, 366 and the paper sheets are slit by the blades 367*a, b.* Each of the wheels 363, 364, 365, 366 are adjustable along the rollers 361, 362, respectively. For example, a fastener 370, such as a screw, having an Allen wrench receptacle is provided, so that the wheels 363, 364, 365, 366 may be positioned and locked in place by tightening the fastener 370. By sliding the wheels 363, 364, 365, 366 along the length of the shaft of cutting rollers 361, 362, a multitude of positions for slits may be provided on the paper sheets fed therethrough.

In an alternate embodiment, the cutting wheels 363, 364, 365, 366 may be replaced by other types of wheels which may provide for serrations, perforations or other processing of paper sheets. The second cartridge 350 may also be replaceable and have mounting members and apertures as discussed for the first cartridge 330 of FIG. 12. As well, in an embodiment, the second cartridge 350 may be interchangeable with the first cartridge 330 and other cartridges having other processing futures such as for perforation or cutting. Therefore, it may be understood that the processing of paper in the paper folding machine may be quickly and easily altered by interchanging the first cartridge 330 with the second cartridge 350 and other types of cartridges. In an embodiment, simply by removing the stacking arm 310, shown in FIG. 10, the first cartridge 330 may be removed and replaced with second cartridge 350. In an embodiment, when a cartridge such as second cartridge 350 is mounted within the paper folding machine, a deflector must be provided in the second upper fold plate so that unfolded paper sheets are received by the second cartridge 350 in order to more easily score, cut or perforate the paper sheets. In an embodiment, a split fold pocket will receive the paper sheets from the fold plate 22*b*. In a further embodiment, only the cutting rollers 361, 362 may be removable.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A folding machine comprising:

a housing including a fold plate having an adjustment bar attached to the fold plate, the adjustment bar for providing a type of fold for the fold plate;

an input table attached to the housing for feeding paper sheets into the housing for processing the paper sheets according to the position of the adjustment bar;

a stacking table attached to the housing for receiving the processed paper sheets exiting the housing;

a stacking arm attached to the housing, the stacking arm extending onto the stacking table, the stacking arm having a roller for assisting in stacking of the processed paper sheets exiting the housing on the stacking table; and a mechanical link connecting the stacking arm to the adjustment bar and the mechanical link providing for adjustment of the stacking arm relative to the type of fold provided by the fold plate and the mechanical link includes a pivot arm and a support arm connected at a pivot point and the roller attached at an end of the support arm.

2. The folding machine of claim 1 wherein the adjustment bar is connected to a sliding arm that actuates the pivot arm.

3. The folding machine of claim 1 further comprising an adjustment arm attached to the pivot arm for adjusting the stacking arm relative to a type of fold selected for the folding machine.

4. The folding machine of claim 3 wherein the adjustment arm provides for adjustment of the stacking arm corresponding to an orientation of the adjustment bar of the fold plate that controls the type of fold provided by the paper folding machine.

5. The folding machine of claim 4 wherein the adjustment arm is attached to the adjustment bar so that upon adjustment of the adjustment arm the stacking arm is simultaneously moved in order to adjust the stacking arm corresponding to the type of fold.

6. The folding machine of claim 5 further comprising an adjustment bar that slides vertically along the fold plate and the adjustment arm is pivotally attached to the adjustment bar so that the adjustment arm causes the roller of the stacking arm to move along the stacking table corresponding to the movement of the adjustment bar.

7. The folding machine of claim 6 wherein the fold plate includes a slot and multiple fold type indicia including large size sheet indicia at a first end of the slot and small size sheet indicia at a second end of the slot and the adjustment bar is slidingly mounted within the slot and movable between the large and small size sheet indicia.

8. The folding machine of claim 7 wherein the stacking table includes a receiving end where folded paper sheets exit the housing and initially are introduced to the table and an accumulating end where the end paper sheets move after additional folded papet sheets are introduced at the receiving end, causing the folded paper sheets to be pushed toward the accumulating end of the stacking table.

9. The folding machine of claim 8 wherein the adjustment end is attached between the stacking arm and the adjustment bar so that upon movement of the adjustment bar from the small size sheet indicia to the large size sheet indicia the stacking arm causes the roller to move from the receiving end of the stacking table to the accumulating end of the stacking table in order to compress the folded paper sheets at the accumulating end.

10. The folding machine of claim 8 wherein the stacking table includes a belt for moving the folded paper sheets from the receiving end to the accumulating end of the stacking table.

11. The folding machine of claim 1 wherein the housing includes a removable plate enclosing a processing area and the plate is quickly removable in a two-step removal process.

12. A folding machine comprising:

a housing including a fold plate having an adjustment bar for providing a type of fold for the fold plate;

an input table attached to the housing for feeding paper sheets into the housing for processing the paper sheets according to the position of the adjustment bar;

a stacking table attached to the housing for receiving the processed paper sheets exiting the housing, a stacking arm attached to the housing, the stacking arm adjacent the stacking table, the stacking arm having a roller for assisting in stacking of the processed paper sheets exiting the housing; and a mechanical link providing for adjustment of the stacking arm relative to the type of fold provided by the fold plate and the mechanical link includes a pivot arm and a support arm connected at a pivot point and the roller attached at an end of the support arm.

13. The folding machine of claim 12 wherein the stacking arm extends onto the stacking table.

14. The folding machine of claim 12 wherein the stacking table includes an accumulating end and a receiving end and the stacking arm adjustably positionable between the accumulating end and the receiving end of the stacking table.

* * * * *

UNITED STATES PATENT AND TRADEMARK OFFICE

CERTIFICATE OF CORRECTION

PATENT NO. : 7,125,374 B2
APPLICATION NO. : 10/806926
DATED : October 24, 2006
INVENTOR(S) : Richard Abramson It is certified that error appears in the above-identified patent and that said Letters Patent is hereby corrected as shown below:

Column 14, line 31, “papet” should be --paper--

Signed and Sealed this

Eighth Day of January, 2008

JON W. DUDAS
*Director of the United States Patent and Trademark Office*